United States Patent [19]

Schuierer

[11] 4,165,548

[45] Aug. 28, 1979

[54] PROCESS FOR THE WET TREATMENT OF ENDLESS STRANDS OF TEXTILE MATERIAL

[75] Inventor: Manfred Schuierer, Michelstadt, Fed. Rep. of Germany

[73] Assignee: Bruckner Apparatebau GmbH, Michelstadt, Fed. Rep. of Germany

[21] Appl. No.: 894,094

[22] Filed: Apr. 6, 1978

[30] Foreign Application Priority Data

Apr. 19, 1977 [DE] Fed. Rep. of Germany ..... 2717313

[51] Int. Cl.[2] ..... D06B 3/24

[52] U.S. Cl. ..... 8/151.1; 8/158; 68/27; 68/176

[58] Field of Search ..... 8/151.1, 152, 158; 68/176, 9, 27

[56] References Cited

U.S. PATENT DOCUMENTS

| | | | |
|---|---|---|---|
| 1,391,276 | 9/1921 | Roberts | 68/176 |
| 1,722,482 | 7/1929 | Rooney | 68/176 X |
| 1,777,989 | 10/1930 | Lane | 68/176 X |
| 2,266,605 | 12/1941 | Jones et al. | 68/176 X |
| 2,301,437 | 11/1942 | Milne | 68/176 |
| 2,378,333 | 6/1945 | Simonds | 68/176 X |
| 2,405,665 | 8/1946 | Nazzaro | 68/176 |
| 3,231,908 | 2/1966 | Kelen et al. | 8/152 |

*Primary Examiner*—Philip R. Coe

*Attorney, Agent, or Firm*—Marshall & Yeasting

[57] ABSTRACT

An endless strand of textile material is initially dyed by transporting it spirally through successive compartments of a vat and simultaneously and separately circulating a homogeneous dye liquor through the compartments individually, and then the textile material is rinsed while continuing to transport it through said successive compartments, by causing a rinsing liquor to flow successively through the compartments in countercurrent to the movement of the textile material.

9 Claims, 6 Drawing Figures

PROCESS FOR THE WET TREATMENT OF ENDLESS STRANDS OF TEXTILE MATERIAL

BACKGROUND OF THE INVENTION

This invention relates to a process for the wet treatment of endless strands of textile material in batches in a wet-treatment vat, in which the textile material is transported along a spiral path through a treating liquid.

It is known that strand-form piece goods sewn endlessly together can be dyed by being transported through a bath of a dye liquid, for example by means of a winch or even by means of a hydraulic system (for example a nozzle system). The main disadvantages of this known process are that the strands of textile material have to be matched exactly with one another in their length in order to obtain optimum dyeing results.

It is also known that printed textile material can be washed by being transported spirally through and rinsed in several vats.

SUMMARY OF THE INVENTION

Accordingly, the object of the present invention is to provide a process of the type described above which gives extremely good wet-treatment results with a high degree of economy, and which in addition can be carried out in a structurally simplified apparatus occupying relatively little space.

According to the invention, this object is achieved in that, using one and the same wet-treatment vat, the textile material is (a) initially dyed by being transported spirally through several separate adjoining, wet-treatment compartments of the vat in which it is exposed to the action of a homogeneous circulating dye liquor, and (b) then rinsed with rinsing liquor which is transported through the individual wet-treatment compartments of the vat in countercurrent to the textile material and enters at the end of the vat at which the textile material exits.

In the process according to the invention, therefore, the textile material to be treated is successively transported through the individual wet-treatment compartments, at least during the dyeing process, each of these wet-treatment compartments containing the same dye liquor which is kept homogeneous throughout by permanent circulation so that, during the dyeing process, all the compartments of the wet-treatment vat are filled with dye liquor having the same temperature, chemical composition and dye composition. In this way, it is possible to obtain optimum dyeing results with a reduced amount of liquor.

On completion of the dyeing process, the dye liquor is run off from the vat, and rinsing liquor or rinsing water is passed successively through all the wet-treatment compartments, starting with the compartment at the end of the vat where the textile material exits, so that the rinsing liquor is pumped through the entire wet-treatment vat (successively through all the wet-treatment compartments) in countercurrent to the textile material. In addition to reducing the amount of dye liquor, this arrangement also provides for a considerable saving in the rinsing process. In addition, piece goods to be treated can be sewn endlessly together to form a strand of considerable length, thereby further increasing the economy of the process.

In addition to these advantages of the process according to the invention, however, it is possible to obtain a very considerable structural advantage by virtue of the fact that both the dyeing operation and the rinsing operation can be carried out in one and the same apparatus or wet-treatment vat, so that apparatus costs and spacing requirements can be reduced.

The wet treatment vat is divided by partitions into a number of wet treatment compartments which communicate with one another through openings above their normal dye liquor level, each wet treatment compartment being connected to a common delivery pump and a common heat exchanger through a separate inlet and outlet for the dye liquor, and inlet for rinsing liquor being provided at the end of the vat at which the textile material exits, for introducing rinsing liquor into the wet treatment compartment situated at that end of the vat, an outlet for the rinsing liquor being provided at the opposite end of the vat for running off rinsing liquor from the wet treatment compartment situated at this opposite end of the vat, and changeover means being provided to enable dye liquor to be separately circulated through the individual wet treatment compartments or rinsing liquor to be delivered in countercurrent to the textile material.

Accordingly, it is possible separately to supply all the wet treatment compartments with dye liquor from a common source and to run off this dye liquor from the individual compartments, again separately be means of a common delivery pump, for the purpose of regeneration. By a comparatively simple changeover operation, the dye liquor can be run off from the individual wet treatment compartments and the supply of dye liquor shut off, so that the supply of rinsing liquor and hence the rinsing operation can be commenced after dyeing.

DESCRIPTION OF THE PREFERRED EMBODIMENTS

Figure 1:
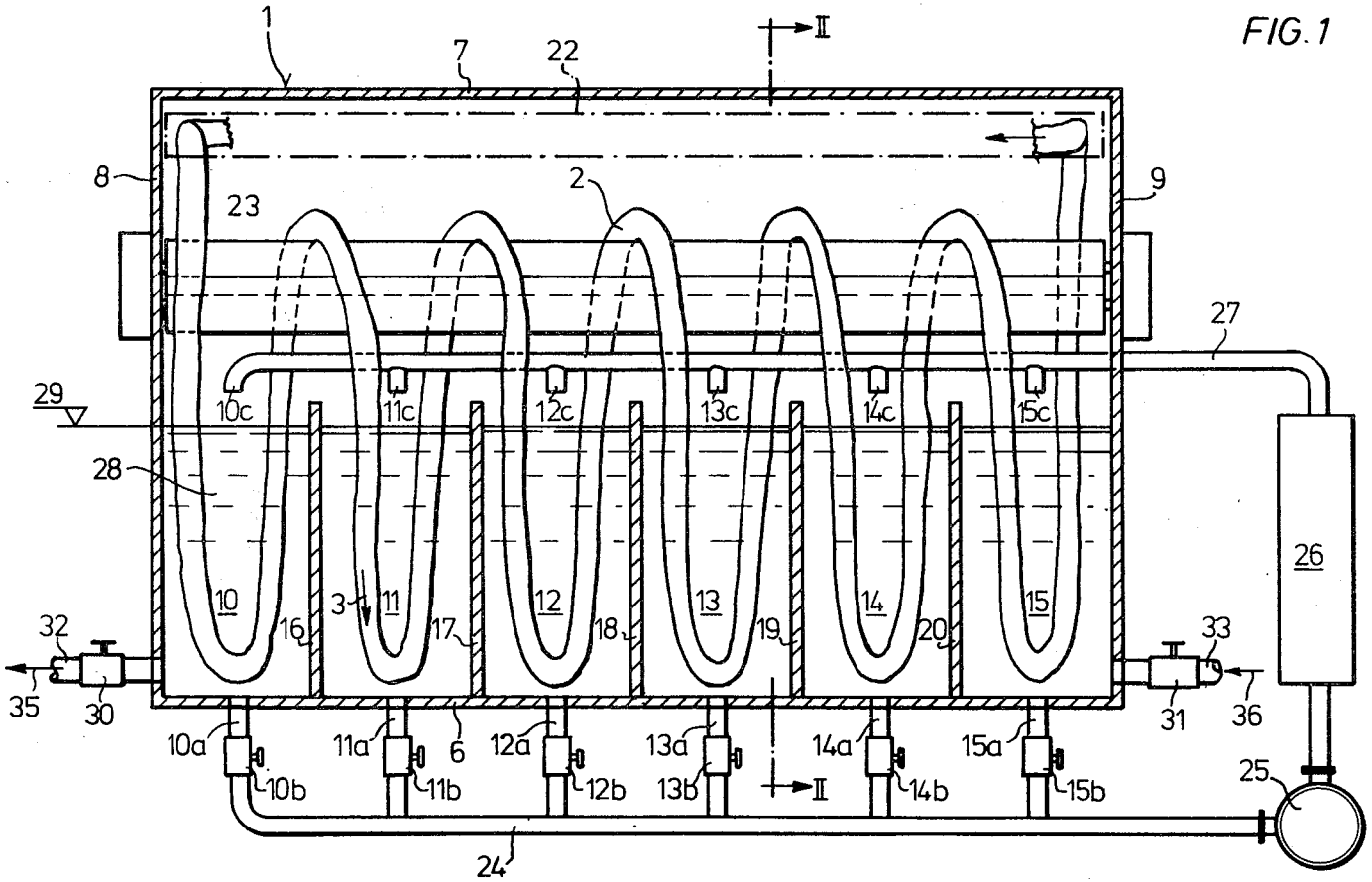
FIG. 1 is a highly simplified longitudinal section through a first embodiment of the apparatus according to the invention.
Figure 2:
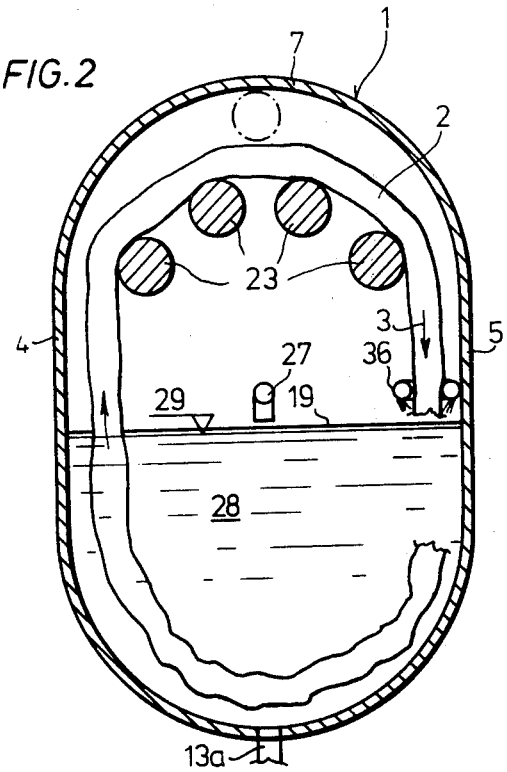
FIG. 2 is a section through the wet treatment vat of the apparatus shown in FIG. 1 (on the line II—II of FIG. 1).
Figure 3:
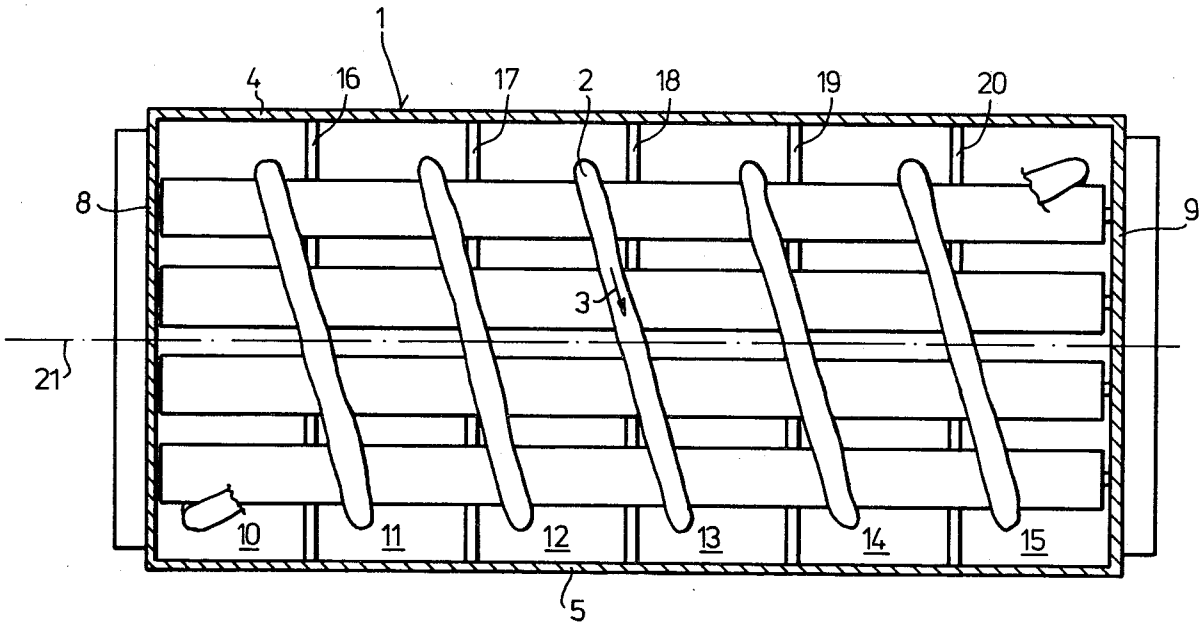
FIG. 3 is a horizontal section through the upper portion of the wet treatment vat of the apparatus shown in FIG. 1.

A first embodiment of a wet-treatment apparatus according to the invention is shown in FIGS. 1 to 3. This wet treatment apparatus includes a wet treatment vat 1 through which the textile material 2 to be treated with liquid is spirally transported in the form of an endless strand in the direction of the arrow 3. The elongate vat 1 may be symmetrical in cross-section, as shown in FIG. 2, and may comprise substantially straight, opposite housing side walls 4, 5, an arcuate base 6 and a correspondingly shaped cover 7, all the above mentioned housing sections preferably merging smoothly with one another.

The cross-section of the vat may of course also assume other forms, for example a cross-sectional form characterised by an inclined base at one end.

The ends of the wet treatment vat 1 are essentially formed by straight, flat walls 8, 9.

According to one important aspect of the invention, the interior of the wet treatment vat 1 is longitudinally divided into a number of wet treatment compartments 10, 11, 12, 13, 14 and 15 (i.e. into six wet treatment compartments in the present case) by partitions 16, 17, 18, 19 and 20 which are sealingly built, preferably welded, into the wet treatment vat 1 and which extend upwards over only part of the internal height of the vat from the base 6 thereof. As can be seen from FIG. 3, the partitions 16 to 20 are arranged substantially at right angles to the longitudinal axis 21 of the vat, being separated at substantially equal intervals from one another and from the adjacent side walls 8 and 9 of the vat 1 and extending parallel thereto, so that in this case all the wet treatment compartments 10 to 15 are equal in size. Above the individual wet treatment compartments 10 to 15, there are guide means and transfer means for the textile material 2 so that the textile material can be guided and transferred from one compartment to the following compartment, the last wet treatment compartment 15 through which the textile material is transported (arrow 3) communicating with the first wet treatment compartment 10, for example through a delivery passage 22 indicated by dash-dot lines (cf. FIG. 1), so that the textile material 2 can be returned from one end of the wet treatment vat 1 to the opposite end, particularly during the dyeing process.

In the embodiment shown in FIGS. 1 to 3, the guide and transfer means are formed by several guide rollers 23, at least some of which are also used for mechanically transporting the textile material. In addition, at least one of these guide rollers could of course also be in the form of a standard winch. The number and size of the guide rollers and winches will generally be determined by the type of textile material to be treated and by the width of the vat 1. In the embodiment illustrated in FIG. 2, the endless textile material 2 is guided through the individual wet treatment compartments 10 to 15 in freely depending form (it could also be temporarily deposited in these compartments). In some cases, however, it would also be possible to use additional guide means in the form of guide rollers.

Whereas, in the embodiment shown in FIGS. 1 to 3, only one side of the textile material 2 lies on the guide rollers 23, it would also be possible to associate a counter roller (not shown) with at least one guide roller in order to obtain greater adhesion and hence to ensure positive transport of the textile material 2. By providing a counter roller of the type in question, as known per se, it would also be possible mechanically to remove surplus water by squeezing from the section of textile material ascending from the associated wet treatment compartment.

In this first embodiment, the guide and transport rollers 23 for the textile material 2 preferably extend over the entire length of the wet treatment vat 1, so that they can be driven by a common drive (not shown).

For each of the wet treatment compartments 10 to 15, the base 6 of the vat comprises a pipe connection 10*a* to 15*a* serving as outlets for the dye liquor, a shut off valve 10*b*, 11*b*, 12*b*, 13*b*, 14*b*, and 15*b* being provided in each of these pipe connections. All the pipe connections 10*a* to 15*a* communicate through a collecting pipe 24 with a common delivery pump 25 for the dye liquor, which at its output or delivery end is connected to a common heat exchanger 26. From the heat exchanger 26, a distributing pipe 27 extends longitudinally through the wet treatment vat 1 above the individual wet treatment compartments 10 to 15. The distributing pipe 27 has outlets 10*c* to 15*c* for each of the wet treatment compartments 10 to 15, these outlets representing the inlets for the dye liquor into the compartments. Accordingly, each wet treatment compartment 10 to 15 may be individually supplied with dye liquor and the dye liquor may be separately run off from each of the wet treatment compartments at their lower ends. In the individual wet treatment compartments 10 to 15, a bath of dye liquor 28 is maintained at a suitable level 29 which lies below the upper edge of the partitions 16 to 20 (for example known level indicators, not shown, may be used for this purpose). In this way, each individual wet treatment compartment 10 to 15 is continuously supplied with fresh dye liquor from a common source so that the particular bath composition may always be kept homogeneous throughout.

Since, in this first embodiment, the partitions 16 to 20 extend over only a certain part of the height of the vat form its base 6, the individual wet treatment compartments 11 to 15 communicate freely with one another through the upper vat space, so that the spirally transported textile material 2 can be guided and transferred without interference in the upper part of the vat.

It can also be seen from FIG. 1 that pipe connections 32, 33 closeable by valves 30, 31 are provided on the end walls 8 and 9 of the wet treatment vat 1 (preferably near its base 6) for the introduction and removal of rinsing liquor. In the present case, it is assumed that the textile material 2 is removed from the vat 1 after the wet treatment, for example in the vicinity of the right-hand end wall 9 of the vat 1. In this case, the rinsing liquor is delivered through the pipe connection 33 provided on the end wall 9, as indicated by the arrow 34, whilst the spent rinsing liquor is removed through the pipe connection 32 provided on the opposite end wall 8, as indicated by the arrow 35.

In addition, change-over means (not shown in detail) are provided, by which—manually or automatically—the dye liquor is run off from the individual wet treatment compartments 10 to 15 on completion of the dyeing process, the shut-off valves 10*b* to 15*b* are closed and the supply of dye liquor to the individual wet treatment compartments is shut off, whilst the introduction the removal of rinsing liquor through the pipe connections 32 and 33 is switched on.

Finally, this first embodiment may comprise means for additionally introducing dye liquor onto the textile material above the wet treatment compartments (or even only over a few certain wet treatment compartments) in the region preceding the point at which the textile material 2 re-enters a wet treatment compartment. As shown in FIG. 2, these means for additionally introducing dye liquor may be formed by a spray system 36 which comprises spray nozzles and which is arranged in the region between the dye liquor level 29 and the last guide roller 23 over which the textile material 2 is transported (arrow 3). If desired, the spray system 36 may also be substantially annular or partly annular in configuration, so that it may also serve as another guide element for the textile material.

The preceding description of the first embodiment of the apparatus according to the invention also provides a clear idea of the process according to the invention. In this process, the textile material 2 is introduced in the usual way into the wet treatment vat 1 in which it is first dyed and then rinsed, i.e. in one and the same vat. During the dyeing process, the textile material 1 sewn endlessly together in strand form is transported spirally in the direction of the arrow 3 through the adjoining, separate wet treatment compartments 10 to 15. This operation may be repeatedly carried out in the required manner by the textile material 2 being returned from the last wet treatment compartment 15 of the vat 1 through the delivery passage 22 to the first wet treatment compartment 10. While the textile material is being transported in this way through the vat 1 or successively through its wet treatment compartments 10 to 15, the wet treatment compartments are kept filled with dye liquor 28 to the required level 29, the dye liquor of each individual wet treatment compartment 10 to 15 being circulated through the separate inlets and outlets 10*c* to 15*c* and 10*a* to 15*a* for the dye liquor by the common delivery pump 25 and the common heat exchanger 26 so that the composition of the dye bath is always kept homogeneous.

As already mentioned, the dye liquor is run off from the individual wet treatment compartments and the supply of dye liquor is switched off on completion of the dyeing process, and rinsing liquor or rinsing water is delivered through the wet treatment vat 1 via the pipe connection 33 in countercurrent to the direction in which the textile material 2 is transported, as indicated by the arrow 3. Accordingly, the rinsing liquor is initially pumped into the wet treatment compartment 15 from below, flows over the upper edge of the partition 20 into the following compartment 14 and so on until it is run off from the opposite compartment 10 through the pipe connection 32. This rinsing operation may be carried out by initially transporting the textile material, still in the form of of an endless strand as in the dyeing process, through the wet treatment vat 1, then severing the strand of textile material after a reasonable time and removing it from the vat 1 in the region of its end wall 9, or—in the case of material which is fairly easy to rinse—by severing the strand of textile material at the beginning of the rinsing process, transporting it spirally towards the end wall 9 and removing it in the region of the end wall 9.

As already mentioned in connection with the transport system for the textile material 2, surplus water may be removed from the section of textile material ascending from a wet treatment compartment (above the dye liquor level 29), not only mechanically (by squeezing) but also by means of a compressed-air nozzle system.

For particularly intensive dyeing, it can be of advantage additionally to supply dye liquor to the textile material 2 before it re-enters the corresponding wet treatment compartment, which in the embodiment shown in FIG. 2 may be done by means of the spray system 36.

Figure 4:
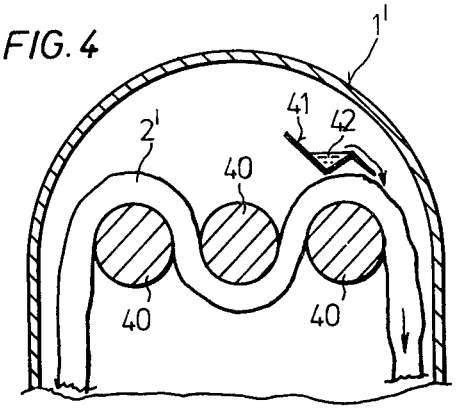
FIG. 4 is a partial vertical section through the upper part of another embodiment of the wet treatment vat, with a modified mechanical transport system for the textile material and an additional facility for the introduction of dye liquor.
Figure 5:
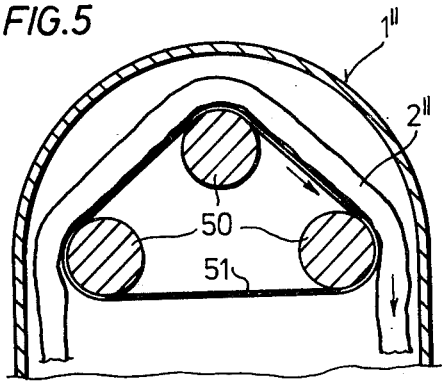
FIG. 5 is a vertical section similar to that shown in FIG. 4, but with another embodiment of the mechanical transport system for the textile material.
Figure 6:
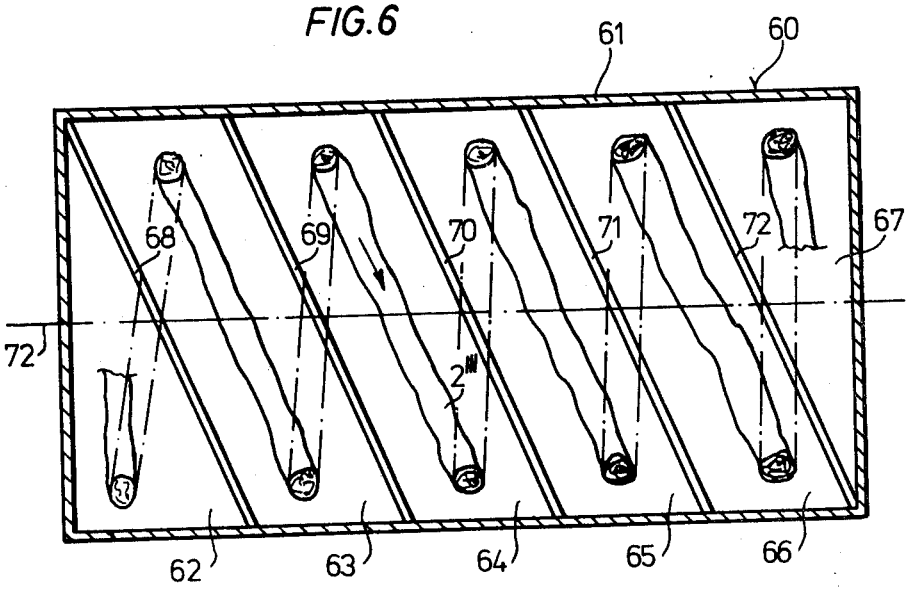
FIG. 6 is a horizontal section (similar to that of FIG. 3) of another embodiment of the invention in which inclined partitions separate the individual wet treatment compartments from one another.

Some other embodiments and procedures characterising the present invention are shown in FIGS. 4 to 6.

Whereas, in the first embodiment (cf. in particular FIG. 2), the textile material 2 is guided over and transported by the guide rollers 23 on one side only, FIG. 4 shows an embodiment in which three guide and transporting rollers 40 (as seen in cross-section) are arranged parallel and adjacent to one another in such a way that the strand-form textile material 2′ is guided on its inside over the two outer guide rollers 40 and on its outside over the middle guide roller 40, so that the textile strand is looped around a larger area of the guide rollers 40, thereby providing greater adhesion for the transport of the textile material through this wet treatment vat 1′.

In addition, means for additionally supplying dye liquor 42, in the form of an overflow barrier 41, is provided in this case over the last guide roller 40 to be contacted by the textile material.

In the embodiment shown in cross-section in FIG. 5 (once again in simplified form only), the guide and transporting rollers used in the preceding embodiments are replaced by a supporting belt 51 circulating endlessly over three guide rollers 50 in the upper part of the wet treatment vat 1″ as the mechanical transport system for the textile material 2″.

In addition to the already described mechanical transport systems for transporting the textile material through the wet treatment vat, it is of course also possible, as known per se, for the textile material to be transported hydraulically by means of liquid nozzles (for example in a nozzle delivery tube), in which case this hydraulic transport system may also be linked with the delivery passage which connects the two wet treatment compartments situated at the opposite ends of the wet treatment vat. In addition, guide and transport systems which are driven independently of one another may of course also be suitably combined with one another.

Finally, FIG. 6 shows another embodiment of a wet treatment vat 60, in whose housing 61 the work treatment compartments 62 to 67 are formed by partitions 68 to 72 which are arranged at equal intervals from and parallel to one another, being installed in the housing 61 (preferably by welding) obliquely of the longitudinal axis 73 of the vat. The oblique positions of these partitions 68 to 72 may be selected in such a way that they correspond to the spiral transport of the textile material 2‴. Apart from this, the remaining fittings and components of the wet treatment apparatus may be designed and arranged in exactly the same way as in the preceding embodiments.

In addition to the embodiments which have been described with reference to the accompanying drawings, other modifications are of course also possible in accordance with the invention.

Thus, for loosely introducing the textile material into the wet treatment compartments, it is possible to provide at least one cuttle motion above the middle of the compartments by which the textile material can be deposited in the wet treatment compartments towards the middle thereof.

In another modification, the adjacent wet treatment compartments communicate with one another through an externally arranged overflow in the form of a vertically adjustable double pipe. This is of importance during rinsing when the rinsing liquor is delivered in countercurrent to the textile material (in which case the rinsing liquor does not of course flow over the upper edges of the partitions from one wet treatment compartment to the other). Finally, it is also possible to arrange a self-aligning roller in the return path from the last wet treatment compartment to the first wet treatment compartment, this self-aligning roller in turn driving a separate winch for introducing textile material into the first wet treatment compartment. In this way, the textile material is loosely returned to the first wet treatment compartment, particularly during dyeing.

I claim:

1. A process for the wet treatment of an endless strand of textile material in a vat which is partitioned into compartments, comprising the steps of (a) initially dyeing an endless strand of textile material by transporting it spirally through successive compartments of the vat and simultaneously and separately circulating a homogeneous dye liquor through the compartments individually, (b) and then rinsing the textile material while continuing to transport it through said successive compartments, by causing a rinsing liquor to flow successively through the compartments in countercurrent to the movement of the textile material.

2. A process as claimed in claim 1, comprising the step of returning the textile material from the last to the first of the successive compartments through which it is being transported, at least during the dyeing step.

3. A process as claimed in claim 1 or 2, wherein the textile material is mechanically transported.

4. A process as claimed in claim 1 or 2 wherein the textile material is hydraulically transported.

5. A process as claimed in claim 1 or 2, comprising the step of removing surplus liquid from the textile material after it emerges from the liquid in a compartment.

6. A process as claimed in claim 1 or 2 comprising the step of delivering additional dye liquor to the textile material before it enters the dye bath in a compartment.

7. A process as claimed in claim 1 wherein the dye liquor is continuously supplied from a common source.

8. A process for the wet treatment of an endless strand of textile material in a vat which is partitioned into compartments, comprising the steps of (a) initially dyeing an endless strand of textile material by transporting it spirally through successive compartments of the vat and simultaneously supplying the compartments of the vat and simulataneously supplying the compartments individually with fresh dye liquor and circulating said dye liquor through the compartments individually, (b) draining the compartments individually on completion of dyeing, (c) and then rinsing the textile material while continuing to transport it through said successive compartments, by causing a rinsing liquor to flow successively through the compartments by flow into one compartment and by overflow into the other compartments in countercurrent to the movement of the textile material.

9. A process as claimed in claim 8 wherein the fresh dye liquor is continuously supplied from a common source.

* * * * *